United States Patent [19]

Catterson

[11] 3,955,904

[45] May 11, 1976

[54] JUNCTION SEAL FOR ROTARY ENGINES

[75] Inventor: Robert K. Catterson, Brookfield, Wis.

[73] Assignee: Briggs & Stratton Corporation, Wauwatosa, Wis.

[22] Filed: June 13, 1975

[21] Appl. No.: 586,582

[52] U.S. Cl. ..... 418/121; 418/142

[51] Int. Cl.[2] ..... F01C 19/08; F01C 19/10

[58] Field of Search ..... 123/8.01; 418/61 A, 418/104, 120, 121, 142

[56] References Cited

UNITED STATES PATENTS

| | | | |
|---|---|---|---|
| 3,081,753 | 3/1963 | Hurley et al. | 418/61 A |
| 3,229,899 | 1/1966 | Springer et al. | 418/120 X |
| 3,640,649 | 2/1972 | Persson | 418/201 X |
| 3,674,384 | 7/1972 | Larrinaga et al. | 418/120 |

*Primary Examiner*—C. J. Husar
*Assistant Examiner*—Leonard E. Smith
*Attorney, Agent, or Firm*—Ira Milton Jones

[57] ABSTRACT

The junction seals at one side of the rotor of a rotary engine are integral parts of the rotor.

7 Claims, 6 Drawing Figures

JUNCTION SEAL FOR ROTARY ENGINES

This invention relates to seals for rotary engines and similar machines and is more particularly concerned with the seals located at the corners of the rotary piston or rotor of such machines, and — more specifically — at the junction of its apex seals and side seals. Accordingly, this invention is classifiable with such patents as the Larrinaga et al U.S. Pat. No. 3,674,384, and those identified therein.

As observed in the aforesaid Larrinaga et al patent, from the inception of the rotary combustion engine there has been a continual effort to provide a better seal between its rotor and housing. That effort has led to the conclusion that the sealing problem is best solved by the combination of apex seals seated in transverse slots in the apexes of the rotor, side seals located in grooves formed in the opposite sides of the rotor and extending substantially from apex seal to apex seal, and corner or junction seals, often termed "button" seals, that prevent leakage at the junctions of the apex and end seals.

Heretofore, and even as late as the advent of the Larrinaga et al patent, the corner or junction seals — like the apex seals and the side seals — have always been spring biased movable inserts set into pockets or recesses formed in the sides of the rotor. The difficulty in meeting the required close tolerances at the several mating surfaces between the corner or junction seals and the side seals — as well as between those seals and the pockets or recesses in which they are seated — are explained in the Larrinaga et al patent. While these difficulties were to some extent minimized by the Larrinaga et al invention, there was still considerable room for improvement. That is the general purpose of this invention.

The elimination of precision machining operations wherever possible will reduce the production costs of any manufactured part. This is especially true for the rotors of rotary engines, but heretofore that objective was still but a fond hope. The present invention is a significant step towards the attainment of that objective.

The now well established powdered metal technique provides an avenue through which production economies can be realized by eliminating, or at least greatly minimizing, machining operations, but heretofore it was not practicable to make rotary engine rotors by this method. One of the reasons why this was so was the need for forming the pockets or recesses at the six corners of the rotor in which the junction seals were located. The formation of these pockets or recesses requires the presence of pins that project from the die surfaces that define the axially opposite side faces of the rotor, and — while the complementary top and bottom sections of the die are translatorily separable — mere separation of the die sections does not free the formed part from the pins that project from the bottom die section. The additional handling entailed in freeing the part from these pins is a deterrent to the production of rotary engine rotors by the powdered metal technique.

The present invention has eliminated that deterrent to the production of rotary engine rotors by the powdered metal technique by the simple expedient of obviating the need for forming pockets or recesses to receive movable junction seals at one side of the rotor.

More specifically, by this invention the junction seals at one side of the rotor are not separate precision machined parts inserted into holes or recesses in the rotor, but integral pads or lugs that project to exactly the same height from that side of the rotor and have coplanar flat surfaces that sealingly engage the contiguous side wall of the housing. At the other side of the rotor, the junctions seals are of the conventional removable variety yieldingly urged outward against the housing side wall.

By having the junction seals at one side of the rotor formed integrally therewith, several significant advantages are gained:

1. Reduction from six to three in the number of the movable precision machined junction seals required, along with the elimination of half of the machining required in fitting the junction seals to the rotor;
2. Production of the rotor by the powdered metal technique is made feasible and practicable;
3. Instead of the six springs heretofore needed to hold the junction seals against the side walls of the housing, only three are required since the reaction to the spring force acting upon the conventional movable junction seals forces the rotor towards the opposite housing side wall and thus presses the fixed junction seals against that wall; and
4. As will be more fully explained hereinafter, the elimination of movable junction seals at one side of the rotor makes possible earlier uncovering of the intake port when that port is located in one of the housing side walls.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate several complete examples of the embodiments of the invention constructed according to the best modes so far devised for the practical application of the principles thereof, and in which.

Figure 1:
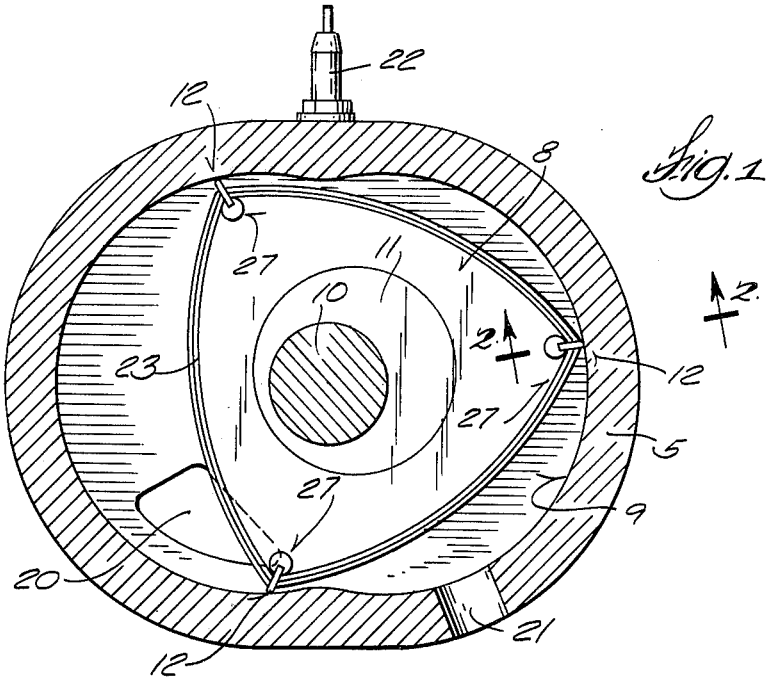
FIG. 1 is a cross sectional view through a rotary engine, illustrating the side of its rotor in which the junction seals are of the conventional movable inserted type.

Referring to the accompanying drawings, the numeral 5 designates the housing of a conventional rotary engine which — together with side walls 6 and 7 that are secured to the opposite sides of the housing — forms a cavity that houses the rotor 8 of the engine. As is conventional, the profile of the inner surface 9 of the housing is a two-lobed trochoid.

A rotor shaft 10 transpierces the side walls 6 and 7 of the housing, with its axis generally coincident with the center of the trochoid defined by the intersection of its major and minor axes. This shaft constitutes the drive shaft of the engine and is journalled in bearings (not shown) that are mounted in the housing side walls. An eccentric journal portion 11 on the shaft 10 freely rotatably mounts the rotor. Accordingly, the rotor revolves planetarily around the axis of the shaft and rotates about the axis of its eccentric journal portion during operation of the engine.

The rotor has three apexes 12 (one more than the two lobes of the trochoidal housing) in each of which there is a transversely extending slot 13. These slots open to the opposite sides 14 and 15 of the rotor and have a uniform cross section from end to end.

Each rotor slot has an apex seal 17 seated in it and yieldingly urged outwardly of the slot by a spring 18 located under the seal, to keep its outer convexly curved edge 19 in engagement with the trochoidal housing surface 9.

Engagement of the apex seals with the trochoidal housing surface divides the housing into three working chambers that vary in volume during operation of the engine and coact with an intake port 20 in the housing side wall 6, an exhaust port 21 and a spark plug or other suitable ignition device 22, to provide the intake, compression, expansion and exhaust phases of a four-cycle engine.

Figure 3:
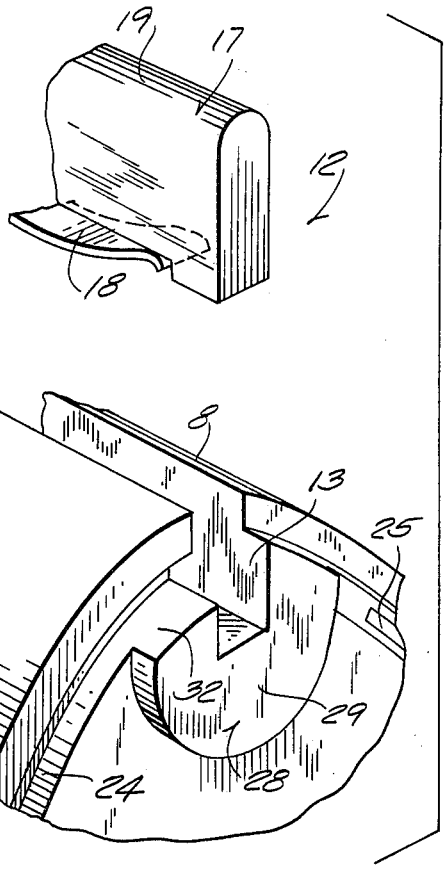
FIG. 3 is a fragmentary perspective view of one of the apex portions of the rotor, viewing the same from the side opposite that shown in FIG. 1, and showing the apex seal and its spring removed from the rotor.
Figure 2:
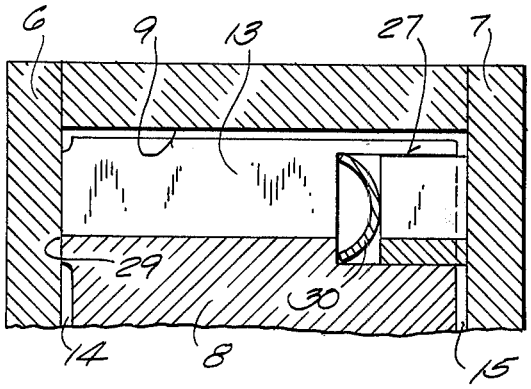
FIG. 2 is a transverse sectional view through one of the three apexes of the rotor taken on the plane of the line 2—2 in FIG. 1 with the apex seal omitted.

The apex seals alone cannot assure the needed isolation of the three working chambers. More is needed. Hence, there are side seals 23 seated in grooves 24 and held in tight sealing engagement with the inner surfaces of the housing side walls 6 and 7 by springs 25 in the bottom of the grooves 24. An end portion of one of these springs is shown in FIG. 3. There are also junction seals 27 at the six corners of the rotor that coact with the side seals 23 to seal the three working chambers from the space formed by the running clearance between the sides of the rotor and the side walls of the housing, which space opens to the bearings in which the rotor shaft is journalled.

Like the side seals, the junction seals 27 are yieldingly maintained in tight sealing engagement with the side walls of the housing, but whereas in past practice all of the six junction seals were separate button-like parts inserted into pockets or recesses formed in the sides of the rotor and individually spring biased into engagement with the housing side walls, in accordance with this invention only three of the six junction seals are of that conventional type; the other three are integral parts of the rotor. Thus at the side 14 of the rotor which is contiguous to the housing side wall 6 (in which the intake port is located) the junction seals consist of pads or bosses 28 the tops of which form coplanar flat plateaus 29 that are equispaced a short distance from the adjacent side face of the rotor. These integral junction seals are held in tight sealing engagement with the housing side wall 6 by the reaction of the rotor to the force of springs 30 beneath the conventional junction seals at the opposite side of the rotor, and to the gas pressure existing in the recesses beneath those seals.

Although the specific configuration of the pads or bosses 28 is subject to modification, their location with respect to the slots 13 in which the apex seals are located and the adjacent ends of the grooves 24, is not. The pads or bosses must embrace at least the inner or bottom portion of the apex slots 13 and encompass the adjacent ends of the grooves 24 as shown in FIGS. 4, 5 and 6, in order to form extensions of the side seals 25 and coact with them in preventing leakage from the working chambers into the space defined by the running clearance between the sides of the rotor and the housing side walls.

Figure 4:
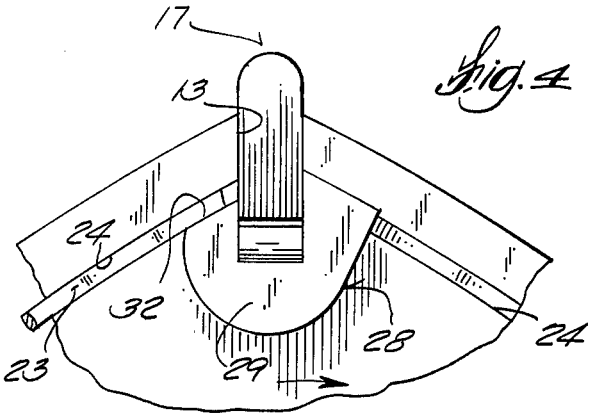
FIGS. 4, 5 and 6 are side views of one apex portion of the rotor, each provided with a differently configured integral junction seal.
Figure 5:
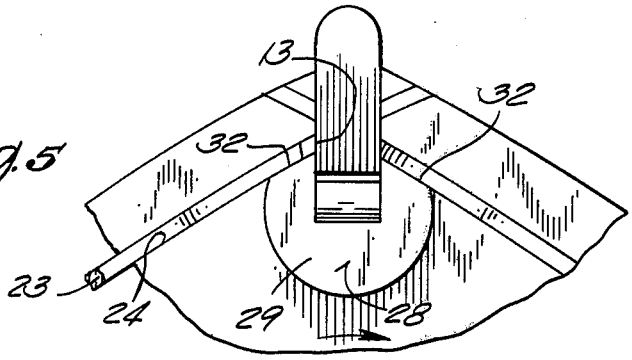
Figure 6:
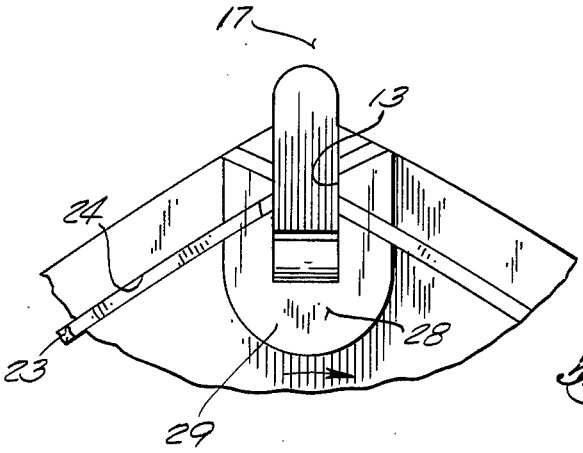

The desired continuity of sealing surface that results from the location of the pads with respect to the grooves 24 is achieved in each of the three different configurations of the pads shown in FIGS. 4, 5 and 6. In FIG. 4, the inner wall 32 at the leading end of the groove 24 — with respect to the direction of rotation of the rotor — forms a side of the pad, so that the sealing surfaces of the adjacent side seal 23 and the sealing surface 29 of the pad can be flush extensions of one another. That flush relationship extends for a distance long enough to assure its retension despite such endwise displacement of the side seal that takes place during operation of the engine. That displacement results from the fact that the trailing end of the groove 24 is directly adjacent to and in fact closed by the leading edge portion of the pad. The trailing end of the side seal thus abuts the pad and is thereby carried along with the rotor against the drag imposed on the side seal by rotation of the rotor.

It will be seen that with this relationship between the grooves 24 and the pads 28, considerable latitude is obtained in fitting the length of the side seals to that of the grooves and that, at both ends of the side seals, continuity of the sealing surfaces is assured even though the extent of the flush relationship between the pad surfaces 29 and the trailing ends of the side seals is necessarily small.

In FIG. 5, the configuration of the pad 28 is symmetrical with respect to the apex slot 13 and at both sides of the slot the inner surface 32 of the flanking grooves 24 forms a side of the pad. Accordingly, the adjacent end portions of both flanking side seals have their sealing surfaces flush with the surface 29 of the pad. This increases the assurance against leakage. It also facilitates machining the grooves 24 since it permits both ends thereof to be cut entirely across the corners of the rotor.

As in the structural relationship of FIG. 4, that of FIG. 5 also provides desirable latitude in fitting the side seals to their respective grooves 24 since, in this case, the length of the side seals need only be sufficient to have the leading end thereof overlap the adjacent surface 32 of the pad when its trailing end abuts the apex seal as shown.

The configuration of the pad 28 in the embodiment of the invention shown in FIG. 6 has all of the advantages of the FIG. 5 arrangement plus increased assurance against leakage around the ends of the apex seals from one working chamber to the other. This desirable feature stems from the fact that in this case the pad 28 encompasses the entire slot 13 and thus has sealing engagement with the housing side walls for the entire depth of the slot.

Another advantage of having the junction seals at one side of the rotor integral therewith is earlier uncovering of the mouth of the intake port, as compared to the constraint in this regard that movable junction seals impose. Obviously, to avoid having the junction seals pop into the intake port or cock in their respective recesses or pockets as they passed the intake port, it was necessary to maintain sliding engagement of a majority of the sealing surface of the movable junction seals with the side wall of the housing as the seals travelled around their orbit. With the integral junction seals of this invention, a smaller part of the sealing surface of each seal has to maintain sliding engagement with the housing side wall. In other words, as the integral junction seals pass the mouth of the intake port, more of that sealing surface can leave contact with the housing side wall and be encompassed by the mouth of the intake port. As a result, greater latitude in the location and size of the mouth of the intake port is achieved, to the end that earlier opening of the intake is possible.

Those skilled in the art will appreciate that the invention can be embodied in forms other than as herein disclosed for purposes of illustration.

The invention is defined by the following claims:

I claim:

1. In a machine of the character described wherein a rotor having circumferentially spaced apexes and axially opposite side faces planetarily revolves about a rotor shaft in a housing having axially spaced side walls in which the rotor shaft is journalled with its opposite side faces contiguous to said side walls of the housing, the housing having a basically trochoidally shaped inner wall surface with which the apexes of the rotor coact to define a plurality of discrete chambers that must be sealed from one another and from the running clearance between the side faces of the rotor and the side walls of the housing, wherein the required sealing is accomplished conjointly by apex seals seated in transverse slots in the apexes of the rotor, side seals in the axially opposite sides of the rotor extending substantially from apex seal to apex seal, and junction seals located at the junctions of the apex seals and the side seals, the improvement which resides in:

the junction seals at one side of the rotor being integral portions of the rotor, while those at the other side of the rotor are parts that are fabricated independently of the rotor and assembled therewith in the conventional manner and hence separable from the rotor.

2. In a machine of the character described wherein a rotor having circumferentially spaced apexes and axially opposite side faces planetarily revolves about a rotor shaft in a housing having axially spaced side walls in which the rotor shaft is journalled with its opposite side faces contiguous to said side walls of the housing, the housing having a basically trochoidally shaped inner wall surface with which the apexes of the rotor coact to define a plurality of discrete chambers that must be sealed from one another and from the running clearance between the side faces of the rotor and the side walls of the housing, wherein the required sealing is accomplished conjointly by apex seals seated in transverse slots in the apexes of the rotor, side seals in the axially opposite sides of the rotor extending substantially from apex seal to apex seal, and junction seals located at the junctions of the apex seals and the side seals, the improvement which resides in:

A. the junction seals at one side of the rotor being immovably fixed with respect to the rotor; and B. the junction seals at the other side of the rotor being seated in pockets formed in the rotor for in and out movement with respect to the rotor, so that pressure manifested in said pockets forces the junction seals therein against the adjacent side wall of the housing and forces the rotor axially towards the other housing side wall, to thereby force said fixed junction seals against said other housing side wall.

3. The invention defined by claim 2, wherein said fixed junction seals are pads projecting from the adjacent side of the rotor and having coplanar flat surfaces that ride on the adjacent side wall of the housing as the rotor turns.

4. The invention defined by claim 3, wherein the housing side wall with which said pads engage has an intake port, the mouth of which opens to the interior of the housing, and further characterized in that the mouth of the intake port is so located with respect to the orbit of said pads as the rotor planetarily revolves about the rotor shaft that although a substantial area of each of said coplanar flat surfaces of the pads crosses the mouth of the intake port, some part of said flat surface remains in sliding engagement with said side wall of the housing.

5. The invention defined by claim 3, wherein the side seals are strips seated in grooves in the sides of the rotor, which grooves have leading and trailing ends with respect to the direction of rotation of the rotor during operation of the machine, and wherein the leading ends of said grooves at that side of the rotor at which said fixed junction seals are located intersect and extend beyond the edges of said pads while at the trailing ends said grooves terminate at the edges of the pads;

and wherein the strips that form the end seals have a length such that the side wall engaging surfaces of the pads and of the contiguous end portions of the strips that are at the leading ends of the grooves are flush with one another and form continuations of one another, while the opposite ends of the strips abut the side edge of the adjacent pads.

6. The invention defined by claim 3, wherein the side seals are strips seated in grooves in the sides of the rotor, the end portions of those of said grooves that are in the side of the rotor at which said pads are located open to the coplanar flat surfaces of the pads and intersect the slots in which the apex seals are seated, and wherein said strips have a length such that the side wall engaging surfaces of the pads and of the leading and trailing end portions of said strips with respect to the direction of rotation of the rotor during operation of the machine, are flush with one another and form continuations of one another, and the trailing ends of said strips abut the adjacent apex seals, the flush relationship of said side wall engaging surfaces of the pads and of the adjacent strips reducing critically in the length tolerance of said side seal strips.

7. The invention defined by claim 6, wherein said pads embrace the adjacent ends of the apex slots and the coplanar flat surfaces of the pads extend to the apexes of the rotor.

* * * * *